US006257430B1

(12) United States Patent
Rinnie et al.

(10) Patent No.: US 6,257,430 B1
(45) Date of Patent: Jul. 10, 2001

(54) TWIST-ON CLOSURE MECHANISM FOR CONTAINER

(75) Inventors: Rolf W. Rinnie, Frankfurt am Main; Gerhard Stoll, Weinboehla; Guido Johne, Dresden; Jochen Jahn, Dresden; Hans-Joachim Gueldenzopf, Dresden, all of (DE)

(73) Assignee: Dental-Kosmetik GmbH Dresden, Dresden (DE)

( * ) Notice: Subject to any disclaimer, the term of this patent is extended or adjusted under 35 U.S.C. 154(b) by 0 days.

(21) Appl. No.: 09/367,085

(22) PCT Filed: Feb. 3, 1998

(86) PCT No.: PCT/DE98/00300

§ 371 Date: Aug. 5, 1999

§ 102(e) Date: Aug. 5, 1999

(87) PCT Pub. No.: WO98/34847

PCT Pub. Date: Aug. 13, 1998

(30) Foreign Application Priority Data

Feb. 7, 1997 (DE) ..... 197 04 625

(51) Int. Cl.[7] ..... B65D 51/00
(52) U.S. Cl. ..... 215/230; 215/232; 220/377
(58) Field of Search ..... 215/203, 211, 215/220, 219, 230, 365, 349, 350, 334, 329, 232; 220/377

(56) References Cited

U.S. PATENT DOCUMENTS

| | | | | |
|---|---|---|---|---|
| 980,352 | * | 1/1911 | Smith | 220/377.1 |
| 2,414,420 | * | 1/1947 | Sebell | 215/230 |
| 2,939,597 | | 7/1960 | Greene . | |
| 3,912,101 | * | 10/1975 | Rayner et al. | 215/220 |
| 4,020,965 | * | 5/1977 | Northup | 215/213 |
| 4,371,088 | * | 2/1983 | Gach | 215/220 |
| 4,446,979 | | 5/1984 | Gasch et al. . | |
| 4,747,499 | * | 5/1988 | Gach et al. | 215/250 |
| 4,852,774 | | 8/1989 | Crawford . | |
| 5,018,632 | * | 5/1991 | Schmidt | 215/230 |
| 5,115,929 | * | 5/1992 | Buono | 215/220 |
| 5,184,739 | * | 2/1993 | Kusz | 215/220 |
| 5,234,118 | * | 8/1993 | Fillmore et al. | 215/220 |
| 5,803,283 | * | 9/1998 | Barker et al. | 215/230 |
| 5,823,373 | * | 10/1998 | Sudo et al. | 215/249 |

FOREIGN PATENT DOCUMENTS

| | | | |
|---|---|---|---|
| 2 044 631 | 5/1991 | (CA) . | |
| 2 105 640 | 3/1994 | (CA) . | |
| 92 12 026 | 12/1992 | (DE) . | |
| 0 554 239 A2 | 8/1993 | (EP) . | |
| 2 107 290 | 4/1983 | (GB) . | |
| 2 203 729 | 3/1987 | (GB) | B65D/41/04 |
| 2 218 077 | 11/1989 | (GB) . | |
| WO 91/0486 | 5/1991 | (WO) . | |

* cited by examiner

*Primary Examiner*—Allan N. Shoap
*Assistant Examiner*—Joe Merek
(74) *Attorney, Agent, or Firm*—Darby & Darby

(57) ABSTRACT

A closing device that has a container shoulder, a container head with an opening for dispensing the contents of the container, and a closure cap operated by a twisting motion. The closure cap has an inner cylinder, a cover plate with at least one window located in the region bounded by the inner cylinder, and a closure lid supported by ribs. Portions a freshness seal secured on the opening of the container head are visible from the outside even if the container is closed.

4 Claims, 2 Drawing Sheets

TWIST-ON CLOSURE MECHANISM FOR CONTAINER

BACKGROUND OF THE INVENTION

The invention relates to a closing device which has a container shoulder, a container head for dispensing the contents of the container, and a closure cap, wherein the closure cap is operated with a twisting motion.

A closure mechanism of this type, which is also referred to as fractal closure mechanism, may be used with containers of arbitrary size and design which can be closed with a cap, wherein the container has an integrated container head with an opening for withdrawing measured quantities from the container.

EP-A-0 554 239 A2 describes a closure mechanism of this type. In this mechanism, a central lid portion presses against the freshness seal affixed to the applicator.

A similar twist-on closure device without a freshness seal is disclosed in DE-C-4342251.

GB 2 218 077 A proposes to form major portions of the closure mechanism or even the entire closure mechanism as a transparent unit.

BRIEF SUMMARY OF THE INVENTION

It is an object of the present invention to provide protection for a first-time user of the container by arranging the protective device, i.e., the freshness seal, in the closure device in such a way that the user can view the freshness seal from the outside.

According to one aspect of the invention, the cover plate of the closure cap has openings or windows located in the region of the inner cylinder of the closure cap, and a closure lid supported by ribs. The closure lid is arranged concentrically inside the cover plate in the form of a closing and sealing surface, with the diameter of the closure lid corresponding at least to the diameter of the container opening, so that the closure lid reliably seals the applicator opening when the closure cap is screwed on.

Portions of the freshness seal which is centered on the front face of the applicator cone of the container head, can be viewed from the outside through the aforedescribed window in the closure lid, even if the container is closed.

The diameter of the freshness seal corresponds to approximately to the diameter of the base area of the applicator cone.

By arranging the freshness seal and the cover plate of the closure cap in the manner described above according to the invention, the user can be assured that the freshness seal is intact and that the packaging of the product has not been tampered with before the first use.

An annular ring or a similar element may be provided on the inside of the closure lid facing the applicator opening of the container head to improve the closing performance of the closure device, wherein the outside diameter of the annular ring is greater than or approximately the same as the inside diameter of the container opening.

The form and the number of the windows of the closing device may be arbitrarily selected. More openings than necessary for viewing the freshness seal from the outside may be provided, thereby saving material and/or providing a more advantageous design.

When used for the first time, the closure mechanism is removed by a rotation of no more than 90°, so that the freshness seal can be pulled off. The pitch and the material strength of the threaded portion and the clamping action of the container shoulder provide a reliable seat of the closure mechanism.

Only a small break-off torque is required for opening the closure mechanism.

BRIEF DESCRIPTION OF THE DRAWINGS

Embodiments of the invention as applied to tube closing mechanisms will be described hereinafter in detail with reference to the drawings, in which.

DETAILED DESCRIPTION OF THE INVENTION

Figure 1A:
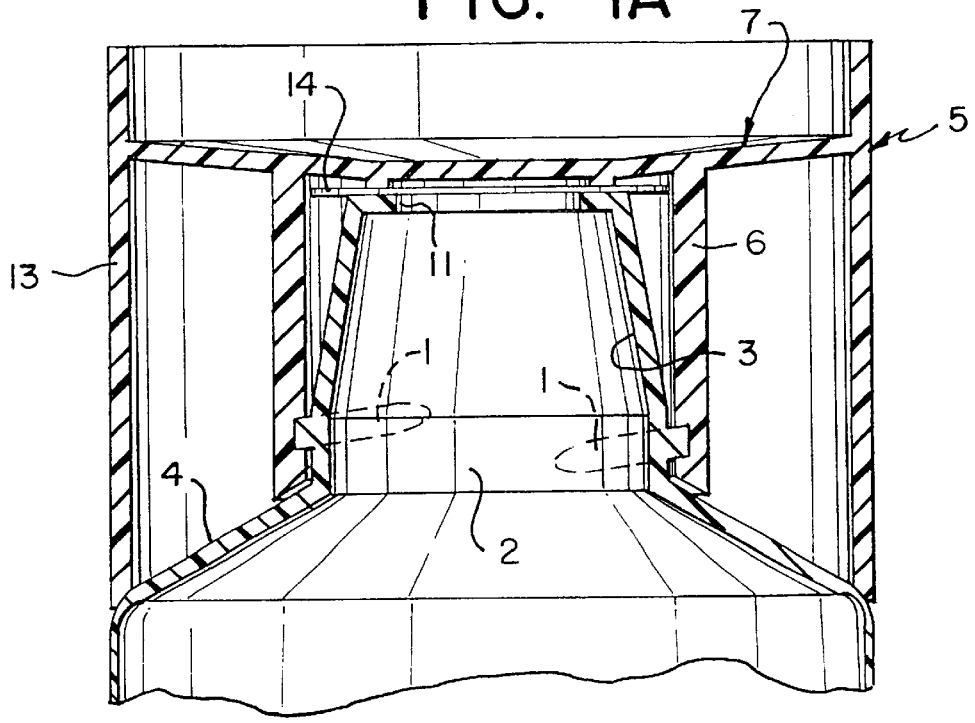
FIGS. 1A and 1B are side cross sectional views of a closure unit.
Figure 1B:
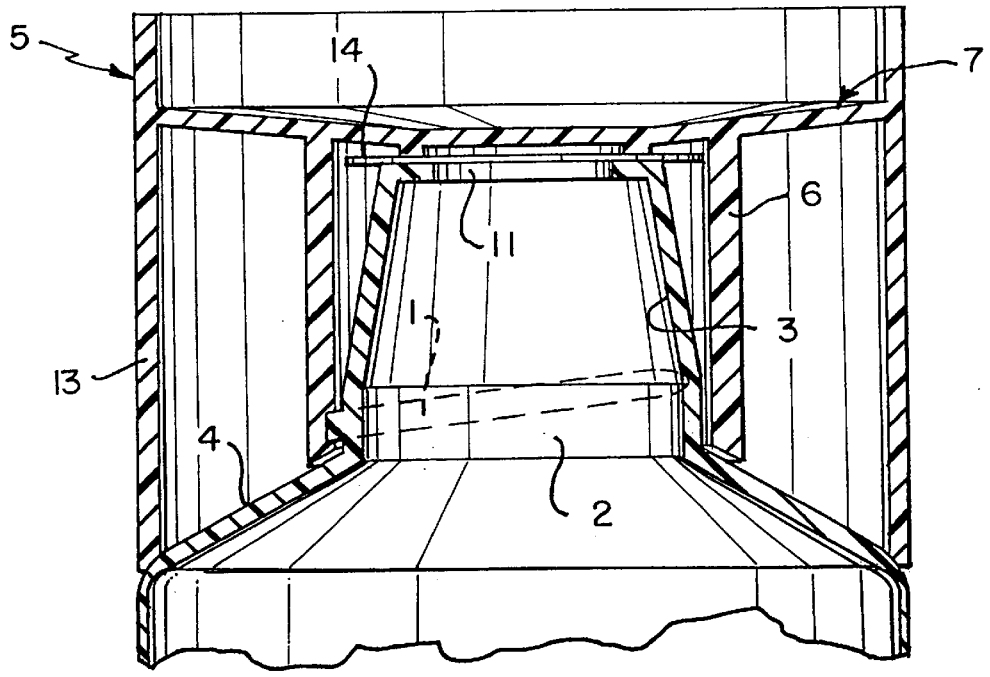

Referring now to FIG. 1A and FIG. 1B, elements of the closure unit, in particular a container head with a cylindrical base region 2 followed by an applicator cone 3, as well as a container shoulder 4 and a closure cap 5 are shown from different viewing angles. The an annular ring 15 is provided on the inside of the closure lid 10 facing the opening 11 of the container head to improve the closing performance of the closure cap. The container head 2, 3 and the closure cap 5 may be made of plastic, for example polyethylene.

Two threaded segments 1 which are implemented as simple helical threads, are arranged in the cylindrical base region 2 of the container head. In the closed position shown in FIG. 1, the closure cap 5 which includes an inner cylinder 6, an outer cylinder 13 and a cover plate 7, are screwed onto the container head. The threaded segments 1 of FIG. 1A engage with a corresponding thread in the end region of the inner cylinder 6 of the closure cap 5.

Figure 2:
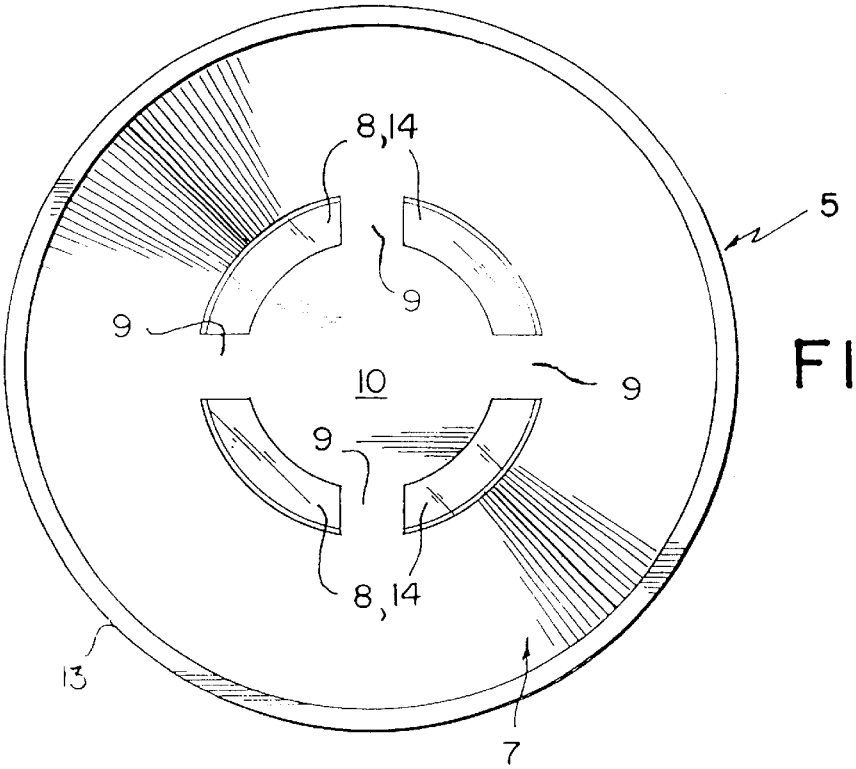
FIG. 2 is a top view of the closure unit with windows required to make the freshness seal visible form the outside.
Figure 3:
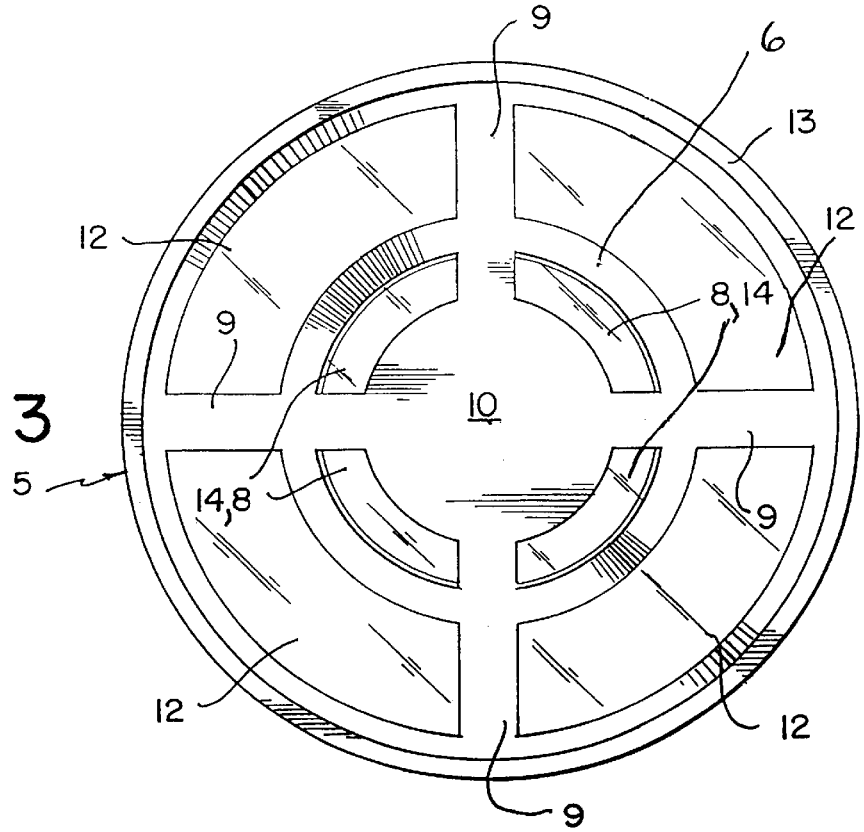
FIG. 3 is a top view of the closure unit with a large number of openings in the cover plate of the closure cap.

The windows 8, 12 disposed in the cover plate 7 of the closure cap 5 are shown in the top views of the closure unit of FIGS. 2 and 3. In the embodiment shown in FIG. 2, the cover plate 7 has only windows 8 which provide a view of the freshness seal 14 from the outside.

The windows 8 are disposed in the region bounded by the diameter of the inner cylinder 6 of the closure cap 5, surrounding the closure lid 10 which is connected to the remaining portion of the cover plate 7 through ribs 9. The diameter of the closure lid 10 is selected so as to provide a closing and sealing surface covering the applicator opening 11.

An annular ring 15 on the inside of the closure lid 10 facing the opening 11 has an outside diameter approximately equal to the inside diameter of the opening 11.

The freshness seal 14 is attached to the font face of the applicator cone 3, sealing the applicator opening 11.

In another embodiment of the invention shown in FIG. 3, the closure cap 5 has additional openings, windows 12, in the cover plate of the closure cap 5. The windows 12 are disposed in an annular zone of the cover plate 7 located between the inner cylinder 6 and the outer cylinder 13, thereby making the shoulder 4 of the container visible from the outside. The ribs 9 connect the closure lid 10 in the radial direction first with the inner cylinder 6 and then also with the outer cylinder 13 of the closure cap 5.

What is claimed is:

1. A twist-on closure cap for a container having a container shoulder and a container head, the container head having a threaded cylindrical base and an opening, the opening being sealed with a freshness seal, the cap comprising:

an outer cylinder;

an inner cylinder having threads corresponding to the threads in the cylindrical base; and a cover plate including a closure lid having a diameter corresponding at least to the diameter of the opening;

the cover plate being connected to the outer cylinder and the inner cylinder;

the closure lid being connected to the cover plate by at least one rib such as to form at least one inner window between the closure lid and the cover plate so that the freshness seal is at least partially visible through the at least one window when said cap is on said container.

2. The twist-on closure cap of claim 1, wherein the diameter of the freshness seal corresponds approximately to the diameter of the cylindrical base of the container head.

3. The twist-on closure cap of claim 1, wherein an annular ring is provided on the inside of the closure lid, wherein the outside diameter of the annular ring is greater than or approximately equal to the inside diameter of the opening of the container head.

4. The twist-on closure cap of claim 1, wherein the at least one rib comprises a plurality ribs forming a plurality inner windows.

* * * * *

UNITED STATES PATENT AND TRADEMARK OFFICE

CERTIFICATE OF CORRECTION

PATENT NO. : 6,257,430 B1
DATED : July 10, 2001
INVENTOR(S) : Rolf W. Rinne

It is certified that error appears in the above-identified patent and that said Letters Patent is hereby corrected as shown below:

Title page,
Item [75], Inventor, change "Rolf W. Rinnie" to -- Rolf W. Rinne --.

Signed and Sealed this

Twelfth Day of March, 2002

*Attest:*

*Attesting Officer*

JAMES E. ROGAN
*Director of the United States Patent and Trademark Office*